US005241126A

United States Patent [19]

Usa et al.

[11] Patent Number: 5,241,126

[45] Date of Patent: Aug. 31, 1993

[54] ELECTRONIC MUSICAL INSTRUMENT CAPABLE OF SIMULATING SPECIAL PERFORMANCE EFFECTS

[75] Inventors: Satoshi Usa; Eiichiro Aoki, both of Hamamatsu, Japan

[73] Assignee: Yamaha Corporation, Hamamatsu, Japan

[21] Appl. No.: 535,956

[22] Filed: Jun. 11, 1990

[30] Foreign Application Priority Data

Jun. 12, 1989 [JP] Japan ..... 1-148827

[51] Int. Cl.[5] ..... G10H 1/053; G10H 1/26; G10H 1/34; G10H 1/46

[52] U.S. Cl. ..... 84/615; 84/626; 84/628; 84/633; 84/644

[58] Field of Search ..... 84/626, 628, 690, 701, 84/704, 687, DIG. 12, 615, 633, DIG. 7; 338/114, 119, 69, 71, 72, 99

[56] References Cited

U.S. PATENT DOCUMENTS

| | | | |
|---|---|---|---|
| Re. 33,089 | 10/1989 | Pepper et al. | 338/119 |
| 3,626,350 | 12/1971 | Suzuki | 338/69 |
| 4,257,305 | 3/1981 | Friend et al. | 84/704 |
| 4,306,480 | 12/1981 | Eventoff et al. | 84/684 |
| 4,444,998 | 4/1984 | House | 338/114 |
| 4,494,105 | 1/1985 | House | 338/69 |
| 4,651,123 | 3/1987 | Zepp | 338/99 |
| 4,700,605 | 10/1987 | Minamitaka | 84/DIG. 7 |
| 4,852,443 | 8/1989 | Duncan et al. | 84/DIG. 12 |
| 4,892,023 | 1/1990 | Takeuchi et al. | 84/704 |
| 4,961,363 | 10/1990 | Mizuno et al. | 84/626 |
| 5,069,106 | 12/1991 | Sakashita | 84/626 |

FOREIGN PATENT DOCUMENTS 50-9947 3/1975 Japan .

*Primary Examiner*—Stanley J. Witkowski
*Assistant Examiner*—H. Kim
*Attorney, Agent, or Firm*—Spensley, Horn, Jubas & Lubitz

[57] ABSTRACT

An electronic musical instrument includes a performance operator such as a bar-like member, a position detection circuit for detecting a play position on the performance operator and generating position information corresponding to the play position, a circuit for selecting a desired one of a plurality of predetermined position-tone pitch conversion characteristics or establishing a desired position-tone pitch conversion characteristic with respect to the performance operator, a conversion circuit for converting the position information from the position detection circuit to tone pitch information in accordance with the position-tone pitch conversion characteristic having been selected or established and a tone generator for generating a tone signal of a tone pitch corresponding to the tone pitch information provided by the conversion circuit. A desired position-tone pitch conversion characteristic can be selected or established and a single performance operator is used for designating tone pitch so that various performances including portamento and glissando can be simulated with a simple structure and operation.

16 Claims, 5 Drawing Sheets

ELECTRONIC MUSICAL INSTRUMENT CAPABLE OF SIMULATING SPECIAL PERFORMANCE EFFECTS

BACKGROUND OF THE INVENTION

This invention relates to a manually playable electronic musical instrument and, more particularly, to an electronic musical instrument of this type having an improved tone pitch designation unit.

In an electronic musical instrument generating a tone signal having a tone pitch corresponding to a play position (i.e., a position at which the performer's finger has touched) on a performance operator, the invention is directed to an improvement according to which means for selecting or establishing a desired play position-tone pitch conversion characteristic is provided and various performance effects such as portamento and glissando can be achieved with a relatively simple structure by designating a tone pitch in the performance operator in accordance with a selected or established position-tone pitch conversion characteristic.

A keyboard has generally been employed as a tone pitch designation means in an electronic musical instrument.

In an electronic musical instrument using a keyboard, one can play a normal music piece and glissando but cannot play portamento in which the tone pitch changes at a desired speed. For realizing such portamento performance, there has been proposed an electronic musical instrument in which a bar-like touch operator (called a "portamento bar") is provided and a continuous tone pitch change is realized by touching this bar-like operator in a sliding manner (e.g., Japanese Utility Model Publication No. 9947/1975).

For achieving various performances including performances of a normal music piece, glissando and portamento in the prior art electronic musical instruments, a plurality of tone pitch designation means such as a keyboard and a portamento bar must be provided in parallel and this will result in complexity in the structure and performance of the electronic musical instrument.

Further, since each key in the keyboard has a determined tone pitch, the glissando performance is limited within determined tone pitches and it is not possible to perform glissando while varying the tone pitch as in a harp.

It is an object of the invention to provide an electronic musical instrument capable of simulating various performance effects with a simple structure and operation.

SUMMARY OF THE INVENTION

The electronic musical instrument achieving the above described object of the invention comprises a performance operator, position detection means for detecting play positions arranged in a predetermined direction on said performance operator and generating position information corresponding to a detected play position, selection means for selecting a desired one of a plurality of predetermined position-tone pitch conversion characteristics with respect to said performance operator, conversion means for converting the position information from said position detection means to tone pitch information in accordance with the position-tone pitch conversion characteristic which has been selected by said selection means, and tone generation means for generating a tone signal of a tone pitch corresponding to the tone pitch information provided by said conversion means.

In one aspect of the invention, the selection means for selecting the position-tone pitch conversion characteristic is substituted by establishing means for establishing a desired position-tone pitch conversion characteristic with respect to said performance operator by designating a desired tone pitch at each play position.

According to the invention, a desired position-tone pitch conversion characteristic can be selected or established and a single performance operator is used as the tone pitch designation means so that various performance effects can be simulated with a simple structure and operation.

By selecting or establishing, for example, a position-tone pitch conversion characteristic which exhibits a continuous tone pitch change for change in the play position, portamento can be realized by a sliding movement of the performer's finger on the performance operator. In this case, a desired tone pitch can be individually designated in between two adjacent pitch names on the performance operator or vibrato can be produced by slightly shifting the play position.

By selecting or establishing a position-tone pitch conversion characteristic which exhibits a tone pitch change in a desired scale (e.g., a tempered scale or a tempered C major scale) for change in the play position, a desired piece of music can be performed in this scale on the performance operator by a successive tone pitch designation.

By selecting or establishing a position-tone pitch conversion characteristic which exhibits a tone pitch change in a desired order of pitch names (e.g., a broken chord or a part of music) for change in the play position, glissando can be performed by a sliding movement of the performer's finger on the performance operator.

A preferred embodiment of the invention will be described below with reference to the accompanying drawings.

BRIEF DESCRIPTION OF THE DRAWINGS

In the accompanying drawings.

DESCRIPTION OF A PREFERRED EMBODIMENT

Figure 1:
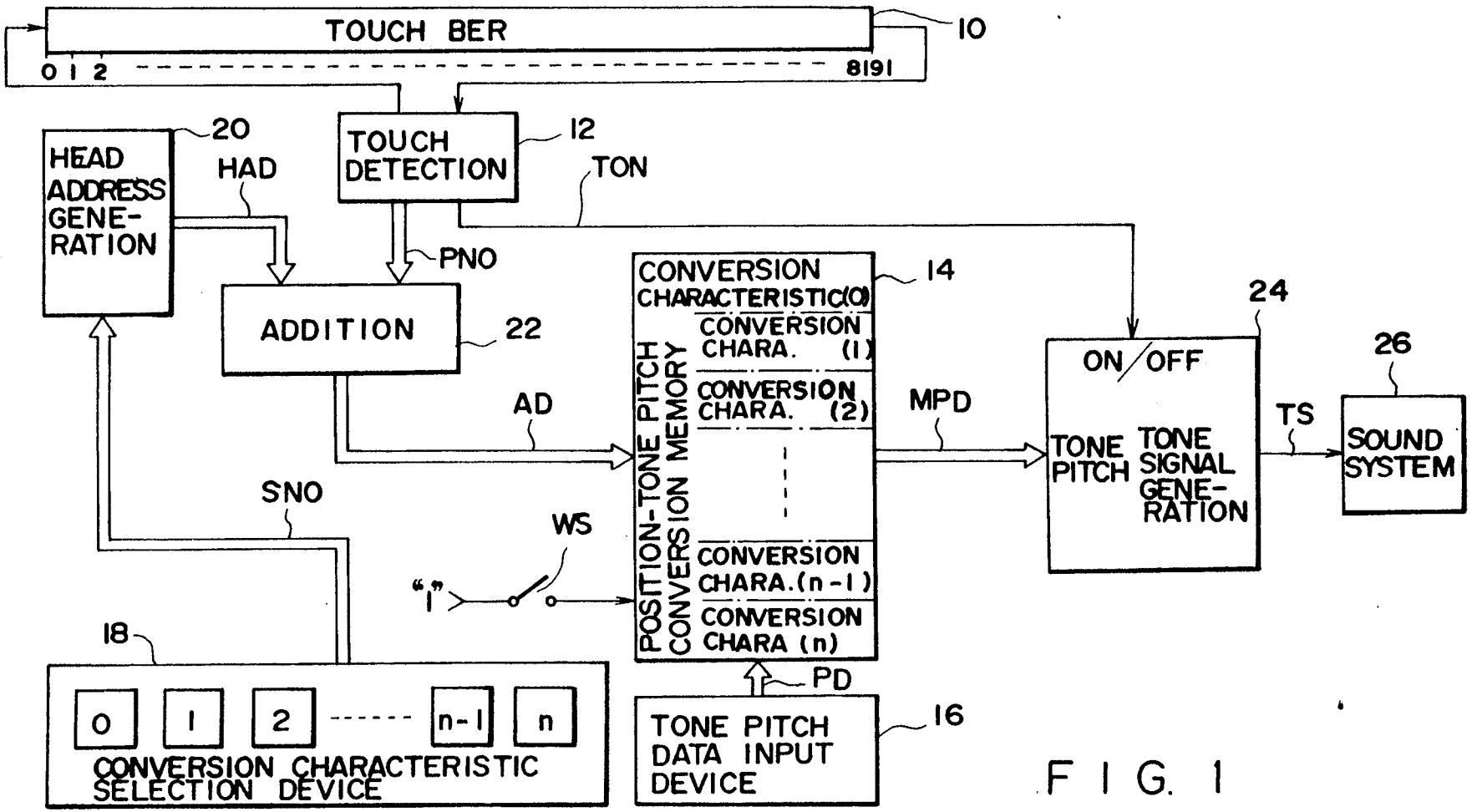
FIG. 1 is a block diagram showing an embodiment of the electronic musical instrument according to the invention.

FIG. 1 shows an embodiment of the electronic musical instrument according to the invention.

A touch bar 10 has a position sensor capable of detecting any touch position in the longitudinal direction of thereof. This position sensor is driven by a touch detection circuit 12 to provide a detection output corresponding to a touch position. The touch bar 10 has, for example, 8192 positions at equal intervals in the longitudinal direction thereof. For the sake of convenience, these positions are identified by position numbers 0 through 8191 starting at one end of the touch bar 10 and extending toward the other end thereof.

The touch detection circuit 12 generates an ON signal TON representing presence of a touch on the touch bar 10 and position number data PNO indicating the position number corresponding to the touch position in response to the detection output of the position sensor of the touch bar 10.

Figure 2:
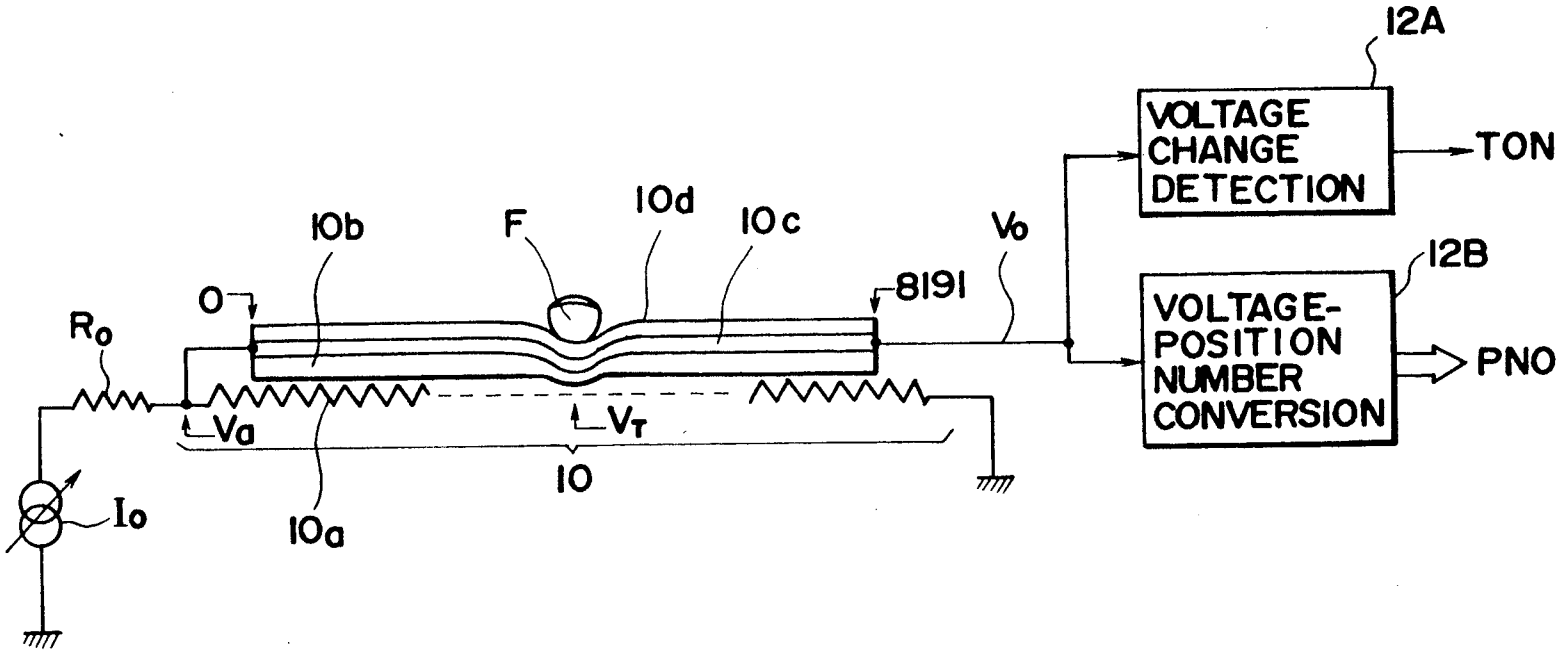
FIG. 2 is a circuit diagram showing an example of a touch detection section.

An example of a touch detection section including the touch bar 10 and the touch detection circuit 12 is shown in FIG. 2. The touch bar 10 is made in the form of a laminate of a resistance sheet 10*a*, a pressure sensitive conductive sheet 10*b*, a conductive film 10*c* and an insulating film 10*d*. The pressure sensitive conductive sheet 10*b* becomes conductive in a portion which is pressed by the performer's finger F and thereby electrically conducts a corresponding portion of the resistance sheet 10*a* with a corresponding portion of the conductive film 10*c*.

An end of the resistance sheet 10*a* is connected to a terminal of a constant current source Io of a variable current value through a resistance Ro. The other terminal of the constant courrent source Io is connected to a reference potential. The other end of the resistance sheet 10*a* is connected also to a reference potential.

The ends of the laminate of the pressure sensitive conductive sheet 10*b*, conductive film 10*c* and insulating film 10*d* are disposed somewhat inwardly from the ends of the resistance sheet 10*a*. One end of the conductive film 10*c* is connected to one end of the resistance sheet 10*a*. A voltage output Vo corresponding to a touch position is delivered out of the other end of the conductive film 10*c* and supplied to a voltage change detection circuit 12A and a voltage-position number conversion circuit 12B.

The voltage output Vo is equal to voltage Va at one end of the resistance sheet 10*a* and, when the performer has touched one of the positions corresponding to the position numbers 0 through 8191, becomes voltage VT which is lower than the voltage Va and corresponds to the touch position. The voltage output Vo rises from the voltage VT to the voltage Va upon release of the performer's finger from the touch bar 10.

The voltage change detection circuit 12A detects the fall from and rise to Va of the voltage output Vo and generates an ON signal TON which assumes the "1" level during the touch of the performer's finger. The generation of the ON signal TON is not affected by a minute voltage change caused by shifting the touch position by a very small distance.

The voltage-position number conversion circuit 12B includes an analog-to-digital conversion circuit and a position number memory and converts the voltage output Vo to position number data PNO. More specifically, assuming that the position numbers 0 through 8191 are used as graduations indicating positions on the touch bar 10, the circuit 12B converts voltages corresponding to touch positions from 0 to 0.5 to position number data PNO indicating 0, voltages corresponding to touch positions larger than 0.5 and smaller than 1.5 to position number data PNO indicating 1, and so on, thereby converting each predetermined range of voltage to position number data PNO indicating a corresponding position number. Therefore, even when the performer has touched a position which, for example, is slightly offset from the graduation 2 on the touch bar 10, the position number data PNO indicating 2 is generated.

In FIG. 1, a position-tone pitch conversion memory 14 consists, for example, of a random-access memory and has the 0-th, first, second, . . . n-th conversion characteristic memory sections. Each of these conversion characteristic memory sections has 8192 memory areas and tone pitch data can be stored in each of the memory areas.

In the 0-th to m-th (n>m) conversion characteristic memory sections among the 0-th through n-th conversion characteristic memory sections, a plurality of tone pitch data corresponding to a plurality of predetermined position-tone pitch conversion characteristics supplied from a suitable device, e.g., a read-only memory, are automatically written at a suitable time point, e.g., upon turning on of a power source. In the (m+1)-th through n-th conversion characteristic memory sections, tone pitch data corresponding to a desired position-tone pitch conversion characteristic can be stored by operating the touch bar 10 and a tone pitch data input device 16 when a write mode has been designated by switching on a write mode switch WS.

The tone pitch data input device 16 includes a dial for designating a tone pitch and an operator such as a switch. Upon designating a desired tone pitch and giving a write command, tone pitch data PD indicating the designating tone pitch is applied to the memory 14 and stored in a memory area designated by address data AD.

A conversion characteristic selection device 18 includes switches 0 through n corresponding to the 0-th through n-th conversion characteristic memory sections of the memory 14. By switching on one of these switches corresponding to a selected conversion characteristic memory section, switch number data SNO indicating the number of this switch is supplied to a head address generation circuit 20.

The head address generation circuit 20 generates head address data HAD indicating a head address for each conversion characteristic memory section by multiplying the value of the switch number data SNO with 8192. This head address data HAD is supplied to an addition circuit 22. The position number data PNO also is supplied from the touch detection circuit 12 to the addition circuit 22.

The addition circuit 22 generates the address data AD by adding the head address data HAD and the position number data PNO together. The address data AD represents the address of a memory area in the selected conversion characteristic memory section. Designating the values of the data AD, PNO and SNO by A, PN and SN respectively, A is represented by the following equation:

$$A = SN \times 8192 + PN$$

In a case where the switch WS has been switched on to designate the write mode and the switch n, for example, has been switched on, data indicating n×8192 is generated as the head address data HAD so that the n-th conversion characteristic memory section is selected. As the performer slides his finger on the touch bar 10 from one end to the other end, the value of the address data AD increases 1 by 1 starting from the value n×8192 until it reaches n×8192+8191. In other words, 8192 memory areas corresponding to 0 through 8191 are sequentially addressed.

By the above described address designation operation, tone pitch corresponding to a desired position-tone pitch conversion characteristic can be stored in the n-th conversion characteristic memory section by designating a desired tone pitch for each touch position corresponding to each position number and giving a write command by the input device 16. The contents of storage in the memory section can be rewritten partially or wholly.

FIGS. 3 through 7 show examples of various position-tone pitch conversion characteristics which can be stored in the memory 14 by using the input device 16 or transferring the data from other memory means.

Figure 3:
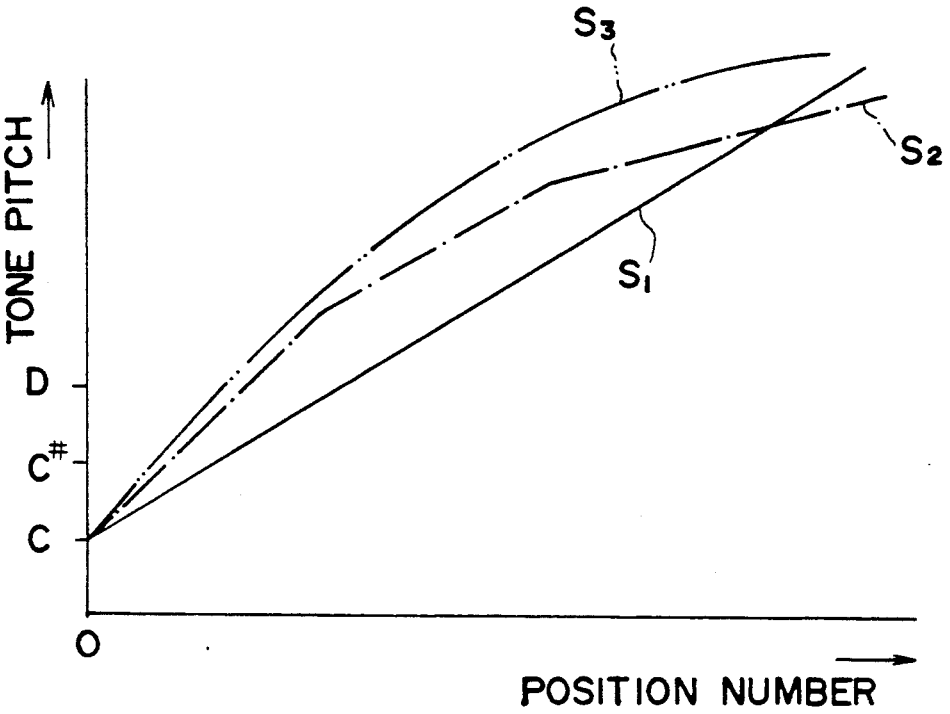
FIGS. 3 to 7 are graphs showing various position-tone pitch conversion characteristics.

In FIG. 3, S1 denotes a conversion characteristic according to which tone pitch rises linearly against increase in the position number and S2 and S3 denote conversion characteristics according to which tone pitch rises non-linearly against increase in the position number. In the characteristic S2, the rate of rising of tone pitch changes in the manner of a line graph and, in the characteristic S3, the rate of rising of tone pitch changes in the manner of a curve. In the characteristics S2 and S3, the rate of rising of tone pitch becomes lower as the tone pitch rises. This is an arrangement for coping with the human hearing characteristic according to which an ability to discriminate tone pitch increases as the tone pitch rises. Coping with the pitch discrimination ability can be made also by employing the conversion characteristic S1 and determining 8192 positions on the touch bar 10 at an inequal interval so that the interval between adjacent positions becomes smaller as the position number increases.

Figure 4:
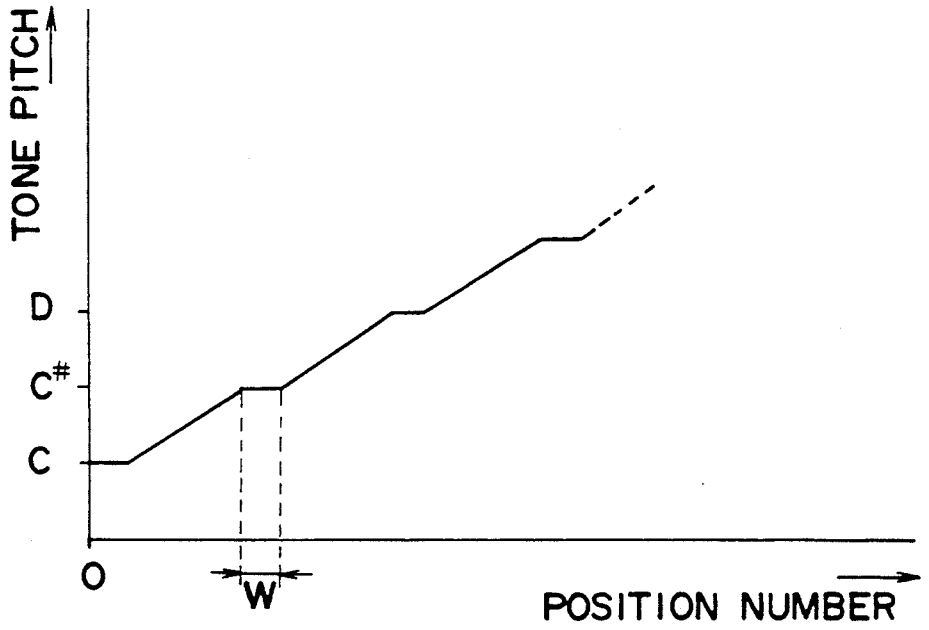

FIG. 4 shows a conversion characteristic according to which tone pitch rises linearly between two pitch names but tone pitch remains the same for position numbers within a certain range W for each pitch name. According to this conversion characteristic, designation of tone pitch for each pitch name can be made easily and accurately.

The conversion characteristics shown in FIGS. 3 and 4 are suitable for performing portamento, sounding a tone of a desired tone pitch between pitch names and imparting a vibrato effect.

Figure 5:
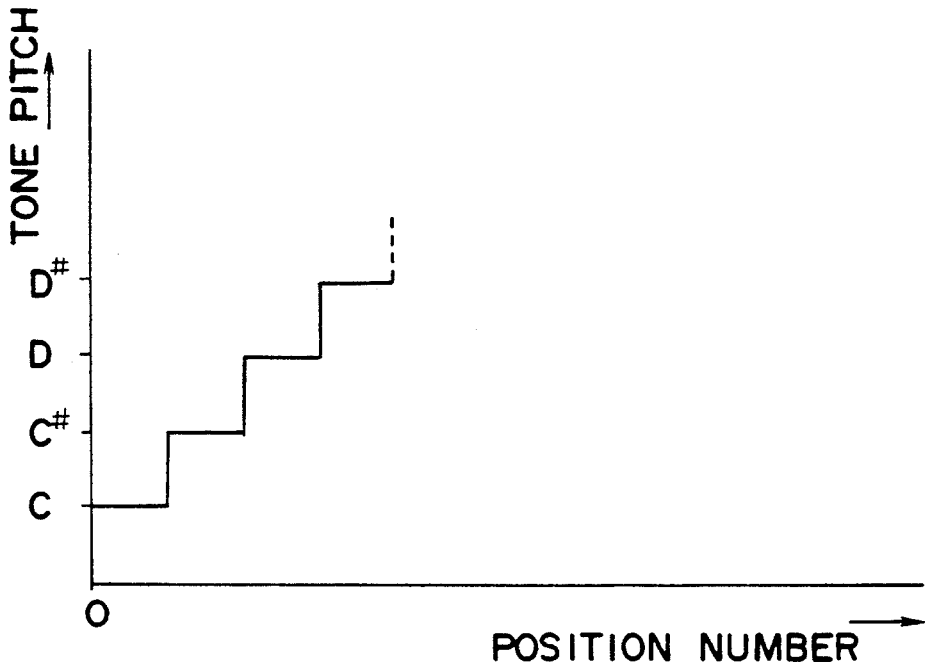
Figure 6:
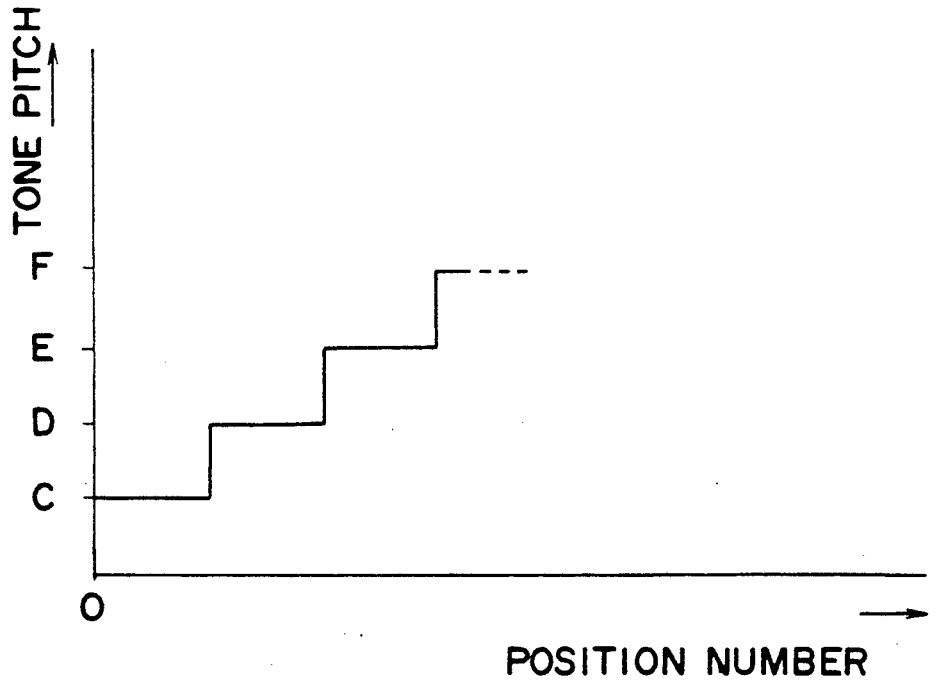

FIG. 5 shows a conversion characteristic according to which tone pitch rises at a semiton interval as the position number increases and FIG. 6 shows a conversion characteristic according to which tone pitch rises in accordance with the C major scale. These conversion characteristics can be used for performing glissando as well as a music piece.

Figure 7:
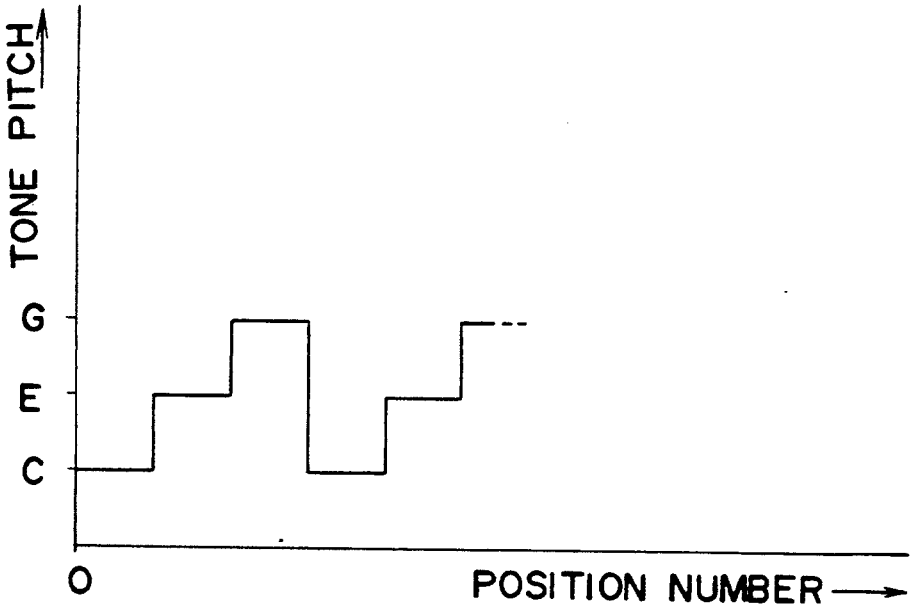

FIG. 7 shows a conversion characteristic according to which tone pitches corresponding to pitch names C, E and G are repeatedly allocated as the position number increases. The tone pitch of each pitch name may be raised or lowered by one octave each time it is repeated. This conversion characteristic is suitable for glissando performance of a broken chord of C, E and G.

In a case where a performance mode has been selected by switching off the switch WS, a desired one of the 0-th through n-th conversion characteristic memory sections can be selected by operation of one of the switches 0 through n in the selection device 18.

Assuming, by way of example, that the conversion characteristic denoted by S1 in FIG. 3 is stored in the 0-th conversion characteristic memory section of the memory 14 and the switch 0 has been switched on in the selection device 18, tone pitch can be designated on the touch bar 10 in accordance with the conversion characteristic S1. If, for example, the performer touches the position of the position number 0 first and then shifts the touch position rightwardly and releases the touch at a position corresponding to the tone pitch of the pitch name C#, a plurality of tone pitch data from C to C# will be read out sequentially from the memory 14 while the touch detection circuit 12 will produce the ON signal TON which rises to the "1" level upon start of the touch and falls to the "0" level upon release of the touch.

A tone signal generation circuit 24 starts generation of a tone signal designated by tone pitch data MPD from the memory 14 in synchronism with rising of the ON signal TON from the touch detection circuit 12 to "1" and starts decaying of the tone signal in synchronism with falling of the ON signal TON to "0". The tone signal generated by the tone generation circuit 24 is supplied to a sound system 26 including an output amplifier and loudspeakers and propagated as a sound.

If a plurality of tone pitch data from C to C# are sequentially read from the memory 14 as in the above described case, a portamento tone in which the tone pitch rises gradually from C to C# will be produced by the sound system 26. If the positions corresponding to C and C# are touched one after another, tones of C and C# will be generated one after another. If the touch position is shifted slightly leftwardly or rightwardly while touching the position corresponding to C#, a vibrato effect will be imparted to the C# tone.

In the above described embodiment, a bar from which an analog output is provided is used as the touch bar 10. Alternatively, switches may be provided in correspondence to the position numbers 0 through 8191 and position information may be generated by scanning these switches. As the performance operator, a slide volume having pressure detection means may be employed.

The ON signal TON may be generated also by operation of an independent tone generation commanding operator.

What is claimed is:

1. An electronic musical instrument comprising:

a performance operator comprising a bar-like member having substantially continuous play positions thereon;

position detection means for detecting play positions arranged in a predetermined direction on said performance operator and for generating position information corresponding to a detected play position;

pitch conversion memory means for storing a plurality of predetermined position-tone pitch conversion characteristics corresponding to said performance operator;

selection means for selecting one of the plurality of stored conversion characteristics which respectively determine relations between tone pitches and said play positions on said performance operator;

conversion means for converting the position information from said position detection means to tone pitch information in accordance with the position-tone pitch conversion characteristic which has been selected by said selection means; and tone generation means for generating a tone signal of a tone pitch corresponding to the tone pitch information provided by said conversion means.

2. An electronic musical instrument as defined in claim 1 wherein said bar-like member has a predetermined number of positions each identified by a position number at a predetermined interval in the longitudinal direction of said bar-like member.

3. An electronic musical instrument as defined in claim 1 wherein said bar-like member is a slide volume having means for detecting pressure applied thereto.

4. An electronic musical instrument as defined in claim 1 wherein said position detection means comprises a laminate formed integrally with said performance operator and having a resistance layer connected to a current source, a pressure sensitive conductive layer superposed on the resistance layer and becoming conductive upon application of pressure thereto, a conductive layer superposed on the pressure sensitive conductive layer and providing a voltage output corresponding to the play position.

5. An electronic musical instrument as defined in claim 2 wherein said position detection means comprises switches provided in correspondence to the position numbers of said performance operator, one of said switches located at the play position being closed for providing the position information.

6. An electronic musical instrument as defined in claim 1 wherein said position-tone pitch conversion characteristic exhibits a continuous tone pitch change for change in the play position.

7. An electronic musical instrument as defined in claim 1 wherein said position-tone pitch conversion characteristic exhibits a tone pitch change in a desired scale for change in the play position.

8. An electronic musical instrument as defined in claim 1 wherein said position-tone pitch conversion characteristic exhibits a tone pitch change in a desired order of pitch names for change in the play position.

9. An electronic musical instrument comprising:

a performance operator comprising a bar-like member having substantially continuous play positions thereon;

position detection means for detecting play positions arranged in a predetermined direction on said performance operator and for generating position information corresponding to a detected play position;

pitch conversion memory means for storing a plurality of predetermined position-tone pitch conversion characteristics corresponding to said performance operator;

establishing means for establishing one of the plurality of stored conversion characteristics which respectively determine relations between tone pitches and said play positions on said performance operator;

conversion means for converting the position information from said position detection means to tone pitch information in accordance with the position-tone characteristic which has been established by said establishing means; and tone generation means for generating a tone signal of a tone pitch corresponding to the tone pitch information provided by said conversion means.

10. An electronic musical instrument as defined in claim 9 wherein said bar-like member has a predetermined number of positions each identified by a position number at a predetermined interval in the longitudinal direction of said bar-like member.

11. An electronic musical instrument as defined in claim 9 wherein said bar-like member is a slide volume having means for detecting pressure applied thereto.

12. An electronic musical instrument as defined in claim 9 wherein said position detection means comprises a laminate formed integrally with said performance operator and having a resistance layer connected to a current source, a pressure sensitive conductive layer superposed on the resistance layer and becoming conductive upon application of pressure thereto, a conductive layer superposed on the pressure sensitive conductive layer and providing a voltage output corresponding to the play position.

13. An electronic musical instrument as defined in claim 10 wherein said position detection means comprises switches provided in correspondence to the position numbers of said performance operator, one of said switches located at the play position being closed for providing the position information.

14. An electronic musical instrument as defined in claim 9 wherein said position-tone pitch conversion characteristic exhibits a continuous tone pitch change for change in the play position.

15. An electronic musical instrument as defined in claim 9 wherein said position-tone pitch conversion characteristic exhibits a tone pitch change in a desired scale for change in the play position.

16. An electronic musical instrument as defined in claim 9 wherein said position-tone pitch conversion characteristic exhibits a tone pitch change in a desired order of pitch names for change in the play position.

* * * * *